US007428795B2

(12) United States Patent
Herring

(10) Patent No.: US 7,428,795 B2
(45) Date of Patent: Sep. 30, 2008

(54) RECEIVER FOR FIREARM

(76) Inventor: Geoffrey A. Herring, P.O. Box 10667, Blacksburg, VA (US) 24062

( * ) Notice: Subject to any disclaimer, the term of this patent is extended or adjusted under 35 U.S.C. 154(b) by 209 days.

(21) Appl. No.: 11/346,514

(22) Filed: Feb. 2, 2006

(65) Prior Publication Data

US 2006/0283067 A1 Dec. 21, 2006

Related U.S. Application Data

(60) Provisional application No. 60/652,300, filed on Feb. 11, 2005.

(51) Int. Cl.
*F41A 21/00* (2006.01)

(52) U.S. Cl. ..... 42/75.01; 89/33.14; 89/33.2

(58) Field of Classification Search ..... 89/33.2, 89/33.14

See application file for complete search history.

(56) References Cited

U.S. PATENT DOCUMENTS 2,032,376 A * 3/1936 Moore ..... 89/33.2
3,035,495 A * 5/1962 Stoner ..... 89/33.2
3,198,076 A * 8/1965 Stoner ..... 89/128
4,392,407 A * 7/1983 LaFever et al. ..... 89/33.14
4,942,802 A * 7/1990 Stoner ..... 89/191.01
5,117,735 A * 6/1992 Flashkes ..... 89/33.14
6,293,040 B1 * 9/2001 Luth ..... 42/75.01
6,681,677 B2 * 1/2004 Herring ..... 89/33.14

OTHER PUBLICATIONS

Lakside Guns AR15/M16 Rimfire Beltfed, www.lakesideguns.com/title1/upper.html, Jan. 2005.*

* cited by examiner

*Primary Examiner*—Michael J. Carone
*Assistant Examiner*—Gabriel J Klein
(74) *Attorney, Agent, or Firm*—Raymond M. Galasso; Galasso & Associates, LP

(57) ABSTRACT

A firearm comprises an upper receiver body and a lower receiver assembly. The upper receiver body is configured for receiving belt-fed ammunition and the lower receiver assembly is attached to the upper receiver body. The lower receiver assembly includes a receiver body having an accessory mounting structure, a trigger group mounting structure, one of an integrally-formed, non-detachable butt-stock mounting structure and an integrally-formed, non-detachable butt-stock, and one of a hand grip mounting structure and an integrally-formed, non-detachable hand grip.

23 Claims, 7 Drawing Sheets

RECEIVER FOR FIREARM

CROSS REFERENCE TO RELATED APPLICATIONS

This patent application claims priority to co-pending U.S. Provisional Patent Application having Ser. No. 60/652,300, filed Feb. 11, 2005, entitled "Mounting Arrangement For A Belted Ammunition Container", having a common applicant herewith and being incorporated herein in its entirety by reference.

FIELD OF THE DISCLOSURE

The disclosures made herein relate generally to firearms and, more particularly, to receivers for firearms.

BACKGROUND

In the 1970's, the United States (U.S.) government issued a requirement that light machine guns (LMG's) issued by various branches of the U.S. military shall have dual ammunition feed capability. Specifically, this dual ammunition feed capability requirement stated that such LMG's were to be capable of receiving magazine-fed ammunition and belt-fed ammunition. Belt-fed ammunition is typically contained in and supplied from a box that is attached to a LMG. The belt-fed ammunition, which is arranged in a belted configuration (e.g., clips connect each round of ammunition to the next round), is fed from the box to a receiver of the LMG. The advantage of belt-fed ammunition is that a supply of belt-fed ammunition is relatively large, thereby enabling sustained firing of the LMG without the need to frequently reload the LMG of ammunition. On the other hand, the benefit of being capable of receiving magazine-fed ammunition is that it readily enables continued operation of the LMG when the supply of belted ammunition is exhausted. The quantity of ammunition that can be supplied by a magazine is relatively small as compared to a supply of belt-fed ammunition. But, a magazine can be installed and, when empty, removed from a LMG in a matter of seconds. Removing and installing a belted ammunition container takes considerably longer to perform than does removing and installing a magazine.

The current U.S. military issue LMG is the M249 SAW (Squad Automatic Weapon). The M249 SAW, whose overall construction is at least partially disclosed in U.S. Pat. No. 4,112,817, has a magazine well located on the left side of the receiver assembly. Because this magazine well location results in the magazine protruding from the left side of the LMG, the magazine well configuration of the M249 SAW is seen as a considerable drawback as it adversely impacts how the M249 SAW is carried, is held/positioned in storming operations and affects use by left and right handed users.

A more preferred orientation for a magazine well is directly below the magazine assembly. With this orientation, the magazine well and an installed magazine extend in the 6 o'clock direction when looking down the longitudinal axis of the receiver with the firearm in a horizontal firing position. For example, the M16 rifle, which is also a standard U.S. military issue firearm, uses this magazine well orientation.

In its original manufacturer configuration, the M-16 rifle is configured for magazine feed capability only, as disclosed in U.S. Pat. No. 3,045,555. However, as disclosed in U.S. Pat. Nos. 6,634,274 and 6,681,677, the M16 rifle may be reconfigured for dual ammunition feed capability (i.e., magazine-fed ammunition and belt-fed ammunition). Some belt-fed machine guns such as the Stoner 63 and the US M60 provide for the mounting of a belted-ammunition container to one side of the weapon. This side-mounted configuration for the belted-ammunition container undesirably results in the rifle being unbalanced.

A known alternative to side-mounting the belted-ammunition container in a dual ammunition feed capable firearm such as, for example, the M-16 rifle disclosed in U.S. Pat. Nos. 6,634,274 and 6,681,677 is to implement a container attachment device that is received within the magazine well. This type of device acts as an interposer connected between the rifle and the belted-ammunition container. An example of such a container attachment device that is received in the magazine well is disclosed in U.S. Pat. No. 6,152,012. A drawback of this type of mounting arrangement for the belted-ammunition container is that the depth of the magazine well and length of the container attachment device result in the belted-ammunition container being positioned relatively low under the rifle. The vertical orientation of the belted-ammunition container with this type of mounting arrangement cause the firearm to set relatively high off of the ground when an operator is firing the rifle in a prone position. Every added inch of vertical height off the ground can place the operator (e.g., the operator's head) in harms way.

Therefore, a mounting arrangement for belted ammunition containers that overcomes drawbacks, limitations and/or shortcomings associated with conventional mounting arrangements for belted ammunition containers would be useful, advantageous and novel.

SUMMARY OF THE PRESENT INVENTION

U.S. government solicitation no. N00164-99-R-0041—LIGHTWEIGHT MACHINE GUNS stipulates that "The LMG shall be belt fed using standard DoD 5.56 mm ammunition with no provision for an attachable/detachable box magazine." One reason for such a solicitation is that, in any armed conflict, U.S. troops can be expected to be out-numbered by enemy troops, often by a large margin. As combat tactics evolve, military and law enforcement organizations are now leaning toward a belt-fed only LMG as their chosen weapon for special operations and counter-terror activities. For example, as recently as 2003, U.S. Special Forces have been issued LMG's having the designation "MK 46 MOD 0" and "MK 48 MOD 0", which are both belt-fed only LMG's manufactured by FN Manufacturing Inc.

Embodiments of the present invention relate to a modular weapon system in which there is an upper receiver body and a lower receiver body that interconnects with the upper receiver body. Variants of the M16-M4 assault rifle are examples of a firearm that includes such an upper receiver body and lower receiver body. More specifically, one embodiment of the present invention is a lower receiver body that is configured for allowing a belt feed ammunition supply (i.e., a belted ammunition container) to be mounted directly on or by way of secondary attachment to the lower receiver body in the physical location that would typically be occupied by a magazine well of the lower receiver body. By mounting directly to the receiver and using the magazine well area, the overall height dimension of the loaded firearm (i.e., with the a belt feed ammunition supply) is much less than is the case with conventional mounting arrangements where the belt feed ammunition supply is mounted below the lower receiver body at the magazine well area.

Reducing this overall height dimension is advantageous in that it serves to aid in keeping the firearm operator's head out of harm's way when firing from the prone position. In the case of a M16-M4 assault rifle configured according to the present invention, the approximate reduction in the overall height dimension is approximately 2.4 inches. As a reference, 2.4 inches is more than 10 bullet diameters of a 0.223 round. As the operator's head is usually the highest critical body part when firing from the prone position, a 2.4-inch reduction in the overall height dimension may save the operator from receiving a fatal head wound in combat. Additionally, a firearm having a belt feed ammunition supply mounting arrangement in accordance with the present invention can be made to be lighter, more compact and centrally balanced.

Clearly, the primary benefits of a lower receiver body in accordance with the present invention are reducing the overall height dimension of a firearm having a belted ammunition container mounted below the lower receiver while maintaining/enhancing the weight, compactness and balance of such a firearm. However, it will be appreciated that, in addition to a belted ammunition container, a lower receiver body in accordance with the present invention is also applicable to other accessories such as a vehicle mount adapter, a tripod and the like. To facilitate such attachment to such other types of accessories, the accessory is configured with a mounting structure that mates with the accessory mounting structure of a lower receiver body in accordance with the present invention.

In one embodiment of the present invention, a receiver body comprises an accessory mounting structure, a trigger group mounting structure, one of an integrally-formed, non-detachable butt-stock mounting structure and an integrally-formed, non-detachable butt-stock, and one of a hand grip mounting structure and an integrally-formed, non-detachable hand grip.

In another embodiment of the present invention, a firearm comprises an upper receiver body and a lower receiver assembly. The upper receiver body is configured for receiving belt-fed ammunition and the lower receiver assembly is attached to the upper receiver body. The lower receiver assembly includes a receiver body having an accessory mounting structure, a trigger group mounting structure, one of an integrally-formed, non-detachable butt-stock mounting structure and an integrally-formed, non-detachable butt-stock, and one of a hand grip mounting structure and an integrally-formed, non-detachable hand grip.

In another embodiment of the present invention, a receiver system comprises an upper receiver body and a lower receiver body. The upper receiver body is configured for receiving belt-fed ammunition. The lower receiver body includes an accessory mounting structure, a trigger group mounting structure, one of an integrally-formed, non-detachable butt-stock mounting structure and an integrally-formed, non-detachable butt-stock, and one of a hand grip mounting structure and an integrally-formed, non-detachable hand grip. The upper receiver body and the lower receiver body are jointly configured for being interconnected.

Turning now to specific aspects of the present invention, in at least one embodiment, the trigger group mounting structure is configured for having a complete trigger group engaged therewith, the accessory mounting structure is configured for having an accessory mounted directly thereon and the butt stock mounting structure extends above an upper receiver interface surface.

In at least one embodiment of the present invention, the accessory mounting structure, and the trigger group mounting structure are each an integrally-formed, non-detachable component of the lower receiver body.

In at least one embodiment of the present invention, the accessory mounting structure is configured for engaging a mating mounting structure of the accessory for securing the accessory in a relatively fixed position with respect to the lower receiver body.

In at least one embodiment of the present invention, the accessory mounting structure includes a tapered engagement surface and the mating mounting structure of the accessory includes a mating tapered engagement surface whereby engagement of said tapered engagement surfaces limits an engagement depth of the accessory with respect to the accessory mounting structure.

In at least one embodiment of the present invention, the accessory mounting structure includes a tapered engagement surface and the mating mounting structure of the accessory includes a mating tapered engagement surface whereby engagement of said tapered engagement surfaces limits an engagement depth of the accessory with respect to the accessory mounting structure.

In at least one embodiment of the present invention, the accessory mounting structure includes a keyed engagement structure and the mating mounting structure of the accessory includes a mating keyed engagement structure configured for being engaged by the keyed engagement structure of the accessory mounting structure.

In at least one embodiment of the present invention, a hand grip attached to the hand grip mounting structure, a butt-stock attached to the butt-stock mounting structure and a complete trigger group mounted on the trigger group mounting structure.

In at least one embodiment of the present invention, the butt stock mounting structure extends above an upper receiver interface surface a centerline axis of the butt stock extends generally along a centerline axis of the upper receiver body.

These and other objects and embodiments of the present invention will become readily apparent upon further review of the following specification and associated drawings.

DETAILED DESCRIPTION OF THE DRAWINGS

Figure 1:
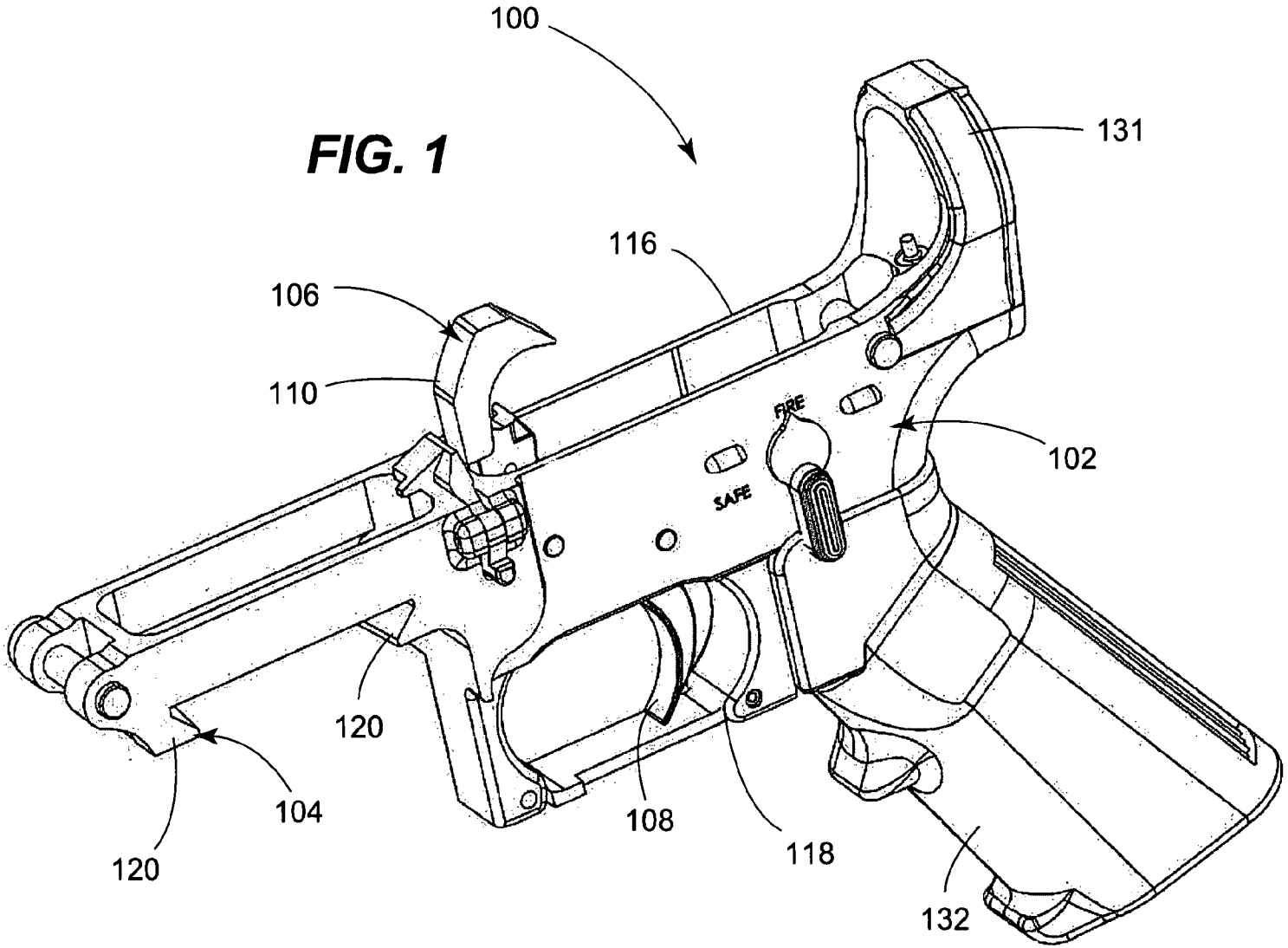
FIG. 1 is a first perspective view depicting an embodiment of a lower receiver body in accordance with the present invention.

FIG. 1 depicts an embodiment of a lower receiver assembly in accordance with the present invention, which is referred to herein as the lower receiver assembly 100. The lower receiver assembly 100 includes a lower receiver body 102 including an accessory mounting structure 104 configured for having an accessory directly mounted thereon. Examples of such accessories include a belted ammunition container, a tripod, a vehicle mount adapter and the like. The lower receiver assembly 100 further includes a trigger group 106 mounted on the lower receiver body.

The trigger group 106 includes a plurality of components (i.e., trigger group components) exclusively mounted on the lower receiver body 102, whereby such components can interact and move as required to provide required trigger group functionality. Thus, the trigger group 106 is fully functional as mounted on the lower receiver body 102. In one embodiment, the trigger group 106 includes a trigger (i.e., trigger 108), a hammer (i.e., hammer 110), a disconnect (not specifically shown), and an automatic sear (not specifically shown). It is contemplated and disclosed herein that the trigger group components may be discrete components each individually mounted directly on the lower receiver body 102 or, optionally, at least a portion of the trigger group components may be configured as a subassembly and the subassembly is mounted on the lower receiver body 102.

Figure 2:
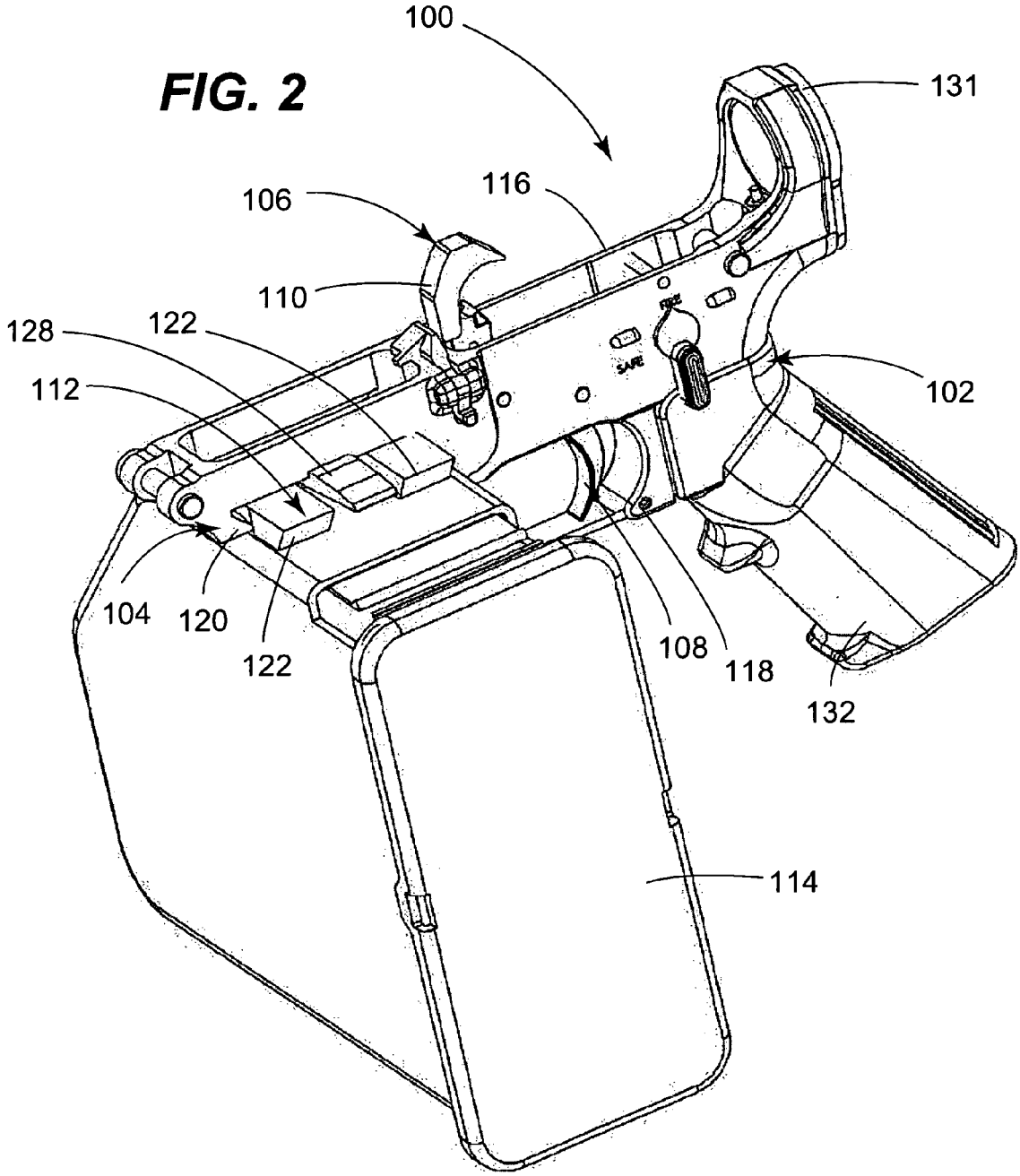
FIG. 2 shows a belted ammunition container mounted on the lower receiver body in FIG. 1.
Figure 3:
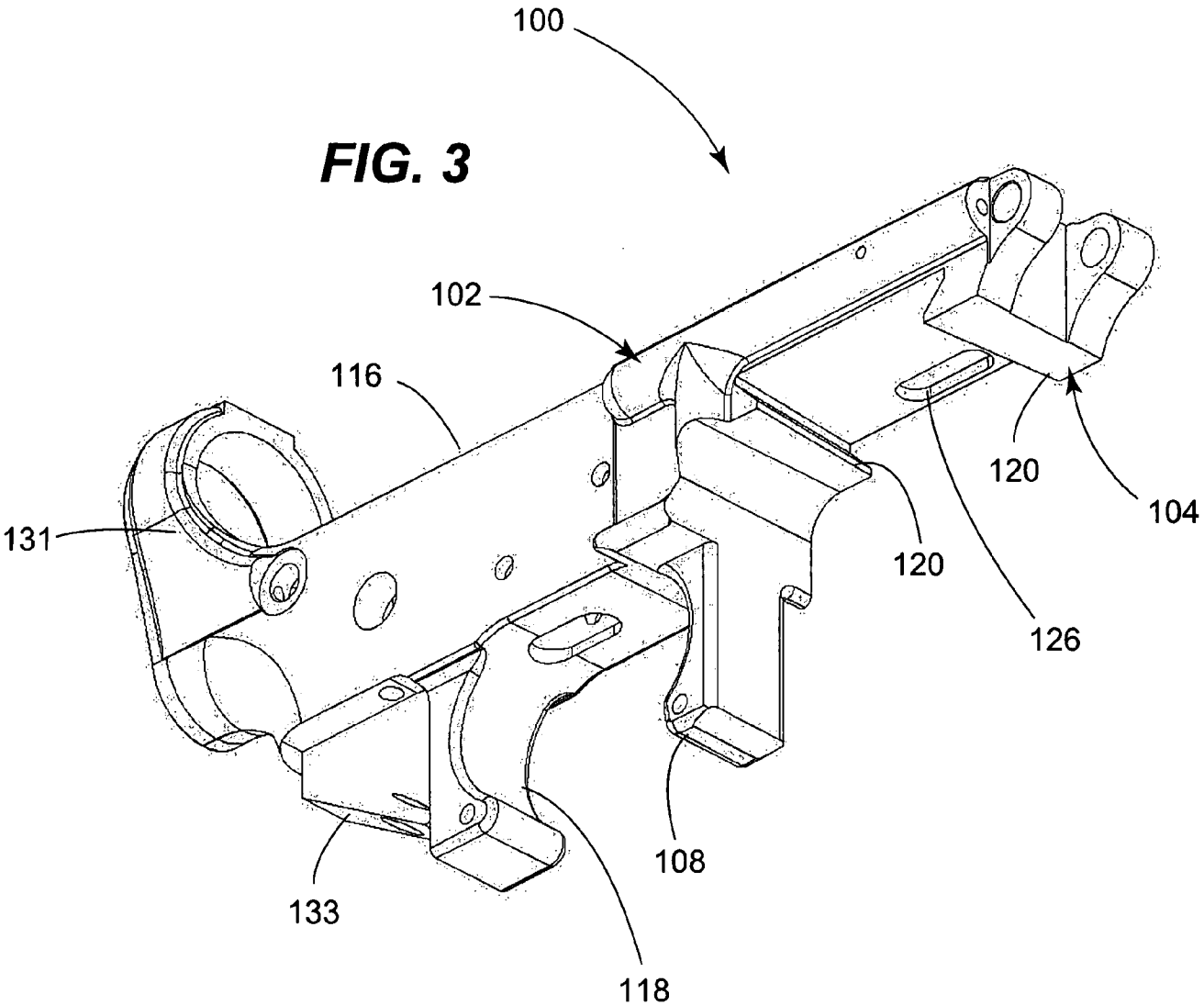
FIG. 3 is a second perspective view of the lower receiver body shown in FIG. 1.

Referring now to FIGS. 1-3, the accessory mounting structure 104 is engaged with a mating mounting structure 112 of a belted ammunition container 114. The accessory mounting structure 104 and the mating mounting structure 112 jointly facilitate securing the belted ammunition container 114 in a relatively fixed position with respect to the lower receiver body 102. Preferably, but not necessarily, the accessory mounting structure 104 is an integrally-formed, non-detachable component of the lower receiver body 102. For example, in one embodiment, the lower receiver body 102 is formed from either a casting blank or from a solid block of material and the accessory mounting structure 104 is cast and/or machined directly in the casting or solid piece of material. Alternatively, the accessory mounting structure 104 is separately fabricated (e.g., via casting and/or machining) and is attached to the lower receiver body 102 by fasteners such as, for example, a plurality of threaded fasteners.

The accessory mounting structure 104 is positioned forward of the trigger group components 106. Additionally, the accessory mounting structure 104 is configured for enabling the belted ammunition container to at least partially reside in front of the trigger group components 106. As depicted in FIGS. 1 and 2, relative to an upper receiver interface surface 116 of the lower receiver body 102, the accessory mounting structure 104 has a lesser degree of vertical offset from the upper receiver interface surface 116 than does a trigger window 118 of the lower receiver body 102. Accordingly, the belted ammunition container 114 resides forward of the trigger group components 106 and partially in front of the trigger group components 106.

Preferably, but not necessarily, the accessory mounting structure 104 includes spaced-apart, tapered engagement surfaces 120 (i.e., that define a tapered slot) that engage mating spaced-apart, tapered engagement surfaces 122 (e.g., that define a mating member) of the belted ammunition container 114. Mating dovetail-style engagement surfaces are an example of the spaced-apart, tapered engagement surfaces (120, 122) of the accessory mounting structure 104 and the belted ammunition container 114. The spaced-apart, tapered engagement surfaces 120 are an example of a keyed engagement structure configured for being engaged by a mating keyed engagement structure (i.e., the mating spaced-apart, tapered engagement surfaces 122) of the belted ammunition container 114.

The spaced-apart, tapered engagement surfaces (120, 122) define a maximum engagement depth of the accessory mounting structure 104 when engaged with the mating mounting structure 112 of the belted ammunition container 114. Thus, the tapered configuration of engagement surfaces (surfaces 120, 122) defines a fully engaged position of the belted ammunition container 114 with respect to the lower receiver body 102 and allow the belted ammunition container 114 to be engaged with the lower receiver body 102 from only one side of the lower receiver body 102 (e.g., the left side). By defining a maximum engagement depth and providing a tapered engagement lead-in configuration, the spaced-apart, tapered engagement surfaces (120, 122) provide for respective mounting structures (104, 112) that decrease the time it takes to adequately change belted ammunition containers. Furthermore, by mounting the belted ammunition container 114 from the side of the lower receiver body rather than from the front of the lower receiver body 114, reduces interference with other components of a firearm (e.g., a tripod, light, hand grip, etc) positioned below a barrel of the firearm.

The lower receiver body 102 includes a pocket 126 (FIG. 3) that receives a retention member 128 (FIG. 2). The pocket 126 and the retention member 128 jointly serve to retain the belted ammunition container 114 in a fixed position (i.e., the engaged position) with respect to the lower receiver body 102. The retention member 128 is selectively movable for disengaging it from the pocket 126 for allowing the belted ammunition container 114 to be disengaged from the lower receiver body 102.

The depicted tapered-configuration of the accessory mounting structure 104 is one embodiment of a specific and preferred configuration. However, other embodiments of configurations for the accessory mounting structure 104 are contemplated and disclosed herein. Examples of such other configurations include, but are not limited to, a picatinny rail extending longitudinally along or laterally across the lower receiver body 102, a T-slot extending longitudinally along or laterally across the lower receiver body 102 and a mounting surface with passages therein (e.g., threaded holes) that is configured for having a mating mounting surface of the belted ammunition container 114 engaged (e.g., abutted) therewith and secured in place with discrete fasteners (e.g., screws). Preferably, but not necessarily, implementation of any one of these alternate embodiments of the accessory mounting structure 104 includes positioning the accessory mounting structure 104 relatively close (e.g., as close as is physically possible) to the upper receiver interface surface 116 such that the belted ammunition container 114 is positioned as close as possible to the upper receiver interface surface 116. The position of the belted ammunition container 114 relative to the lower receiver body 102 as depicted in FIGS. 1-3 represents a relatively close mounting position of the belted ammunition container relative 114 to the lower receiver body 102.

Still referring to FIGS. 1-3, the lower receiver body 102 includes a load-bearing support member 131. The load-bearing support member 131 is preferably, but not necessarily, an integrally formed, non-detachable component of the lower receiver body 102. The load-bearing support member 131 extended vertically above the upper receiver interface surface 116 of the lower receiver body 102. In at least one embodiment of the load-bearing support member 131, the load-bearing support member 131 includes means such as, for example, an aperture configured for enabling a butt-stock to be attached to the load-bearing support member 131. The means for enabling attachment of the bitt-stock is positioned such that a centerline of the butt stock extends generally along a centerline axis of the upper receiver assembly (e.g., along a longitudinal axis of a bolt carrier group bore). In this manner, the load-bearing support member 131 serves as a but-stock attachment means.

As depicted in FIGS. 1 and 2, the lower receiver body 102 is configured for having a handgrip 132 mounted completely thereon. As depicted in FIG. 3, the lower receiver body includes a hand grip mounting structure 133 that is configured for having the hand drip 132 attached thereto. The handgrip mounting structure 133 is preferably, but not necessarily, an integrally formed, non-detachable component of the lower receiver body 102 (i.e., is formed in combination with a main portion of the lower receiver body 102).

Figure 4:
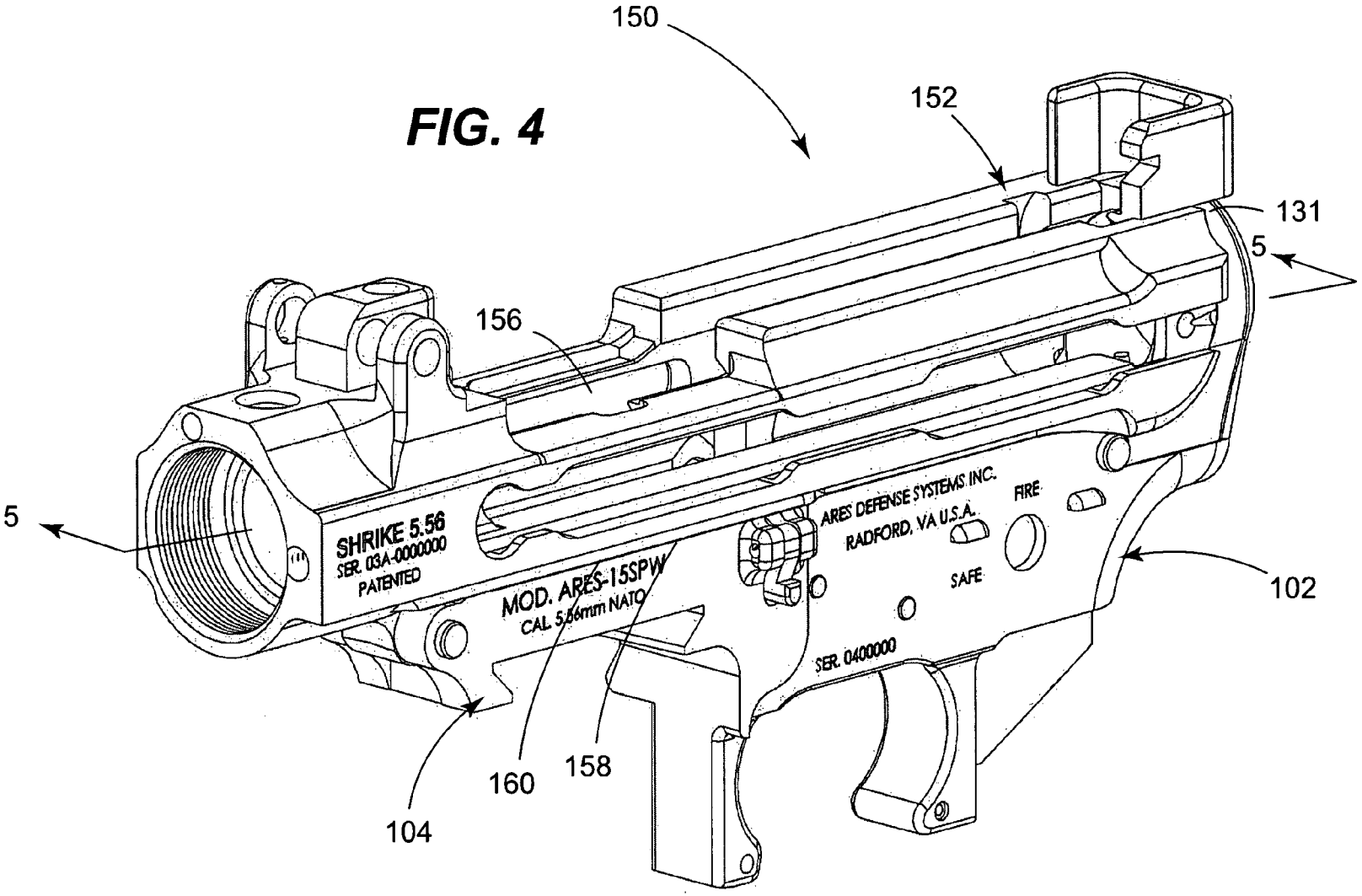
FIG. 4 is a perspective view depicting a receiver system in accordance with the present invention.
Figure 5:
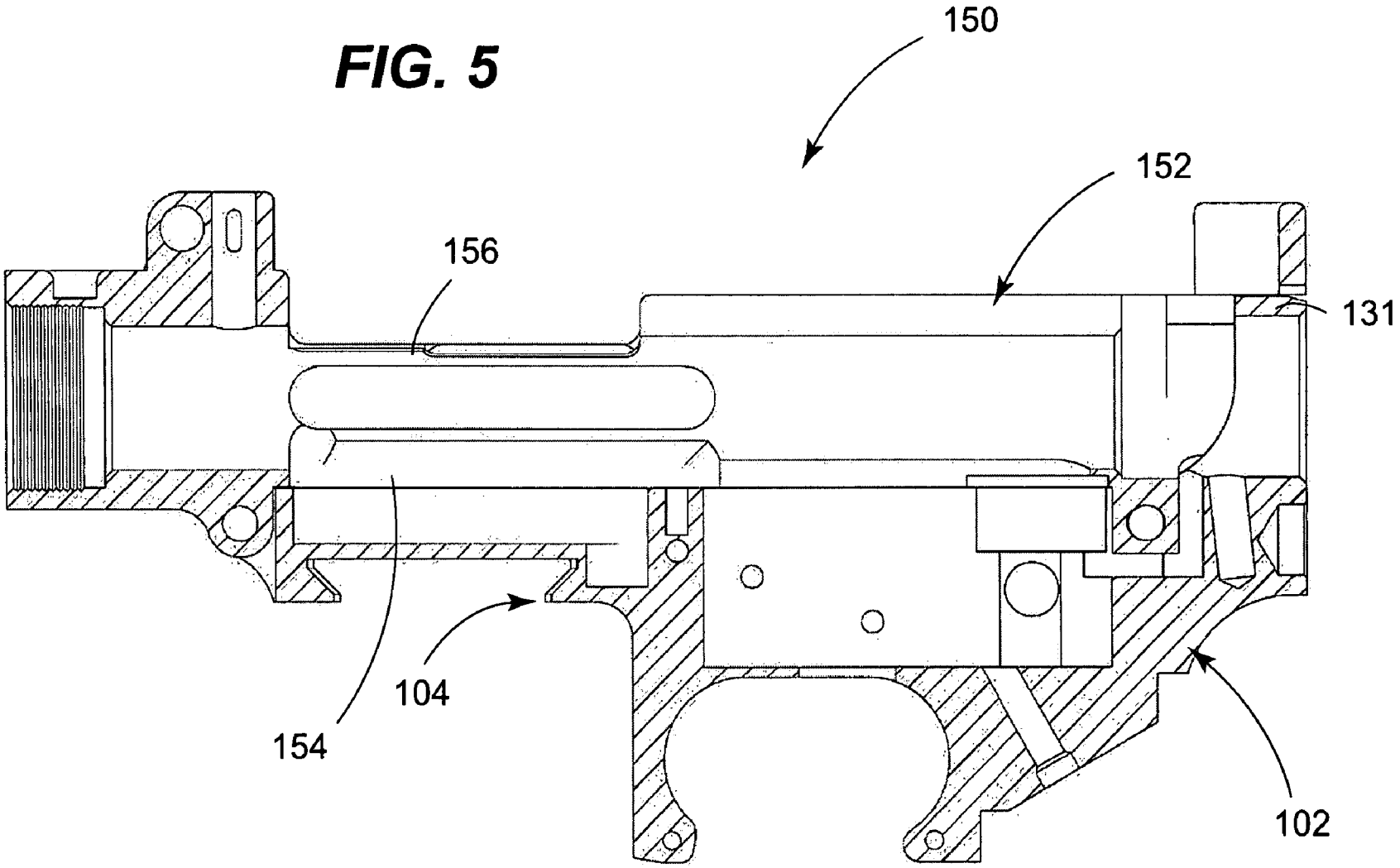
FIG. 5 is a cross-sectional view taken along the line 5-5 in FIG. 4.

FIGS. 4 and 5 depict a receiver system in accordance with the present invention, which is referred to herein as the receiver system 150. The receiver system 150 includes the lower receiver body 102 depicted in FIGS. 1-3 and an upper receiver body 152. The upper receiver body 152 (i.e., a first receiver body) and the lower receiver body 102 (i.e., a second receiver body) are jointly configured for being interconnected at mating interface surfaces (i.e., along interface 158) and are interconnectable in a manner that enables interoperability between receiver components of the lower receiver body 102 and the upper receiver body 152.

The upper receiver body 152 includes a first ammunition insertion port 154 configured for having magazine-fed ammunition provided therethrough from an ammunition magazine and a second ammunition insertion port 156 configured for having belt-fed ammunition provided therethrough from a belt-fed ammunition apparatus. The first ammunition port 154 of the upper receiver body 152 extends through an interface surface 160 of the upper receiver body 152. In one embodiment, the accessory mounting structure 104 is positioned such that it precludes insertion of ammunition through the first ammunition insertion port 154 when the upper receiver body 152 is interconnected with the lower receiver body 102 (e.g., the accessory mounting structure encroaches into an area defined by a perimeter of the first ammunition insertion port 154).

Figure 6:
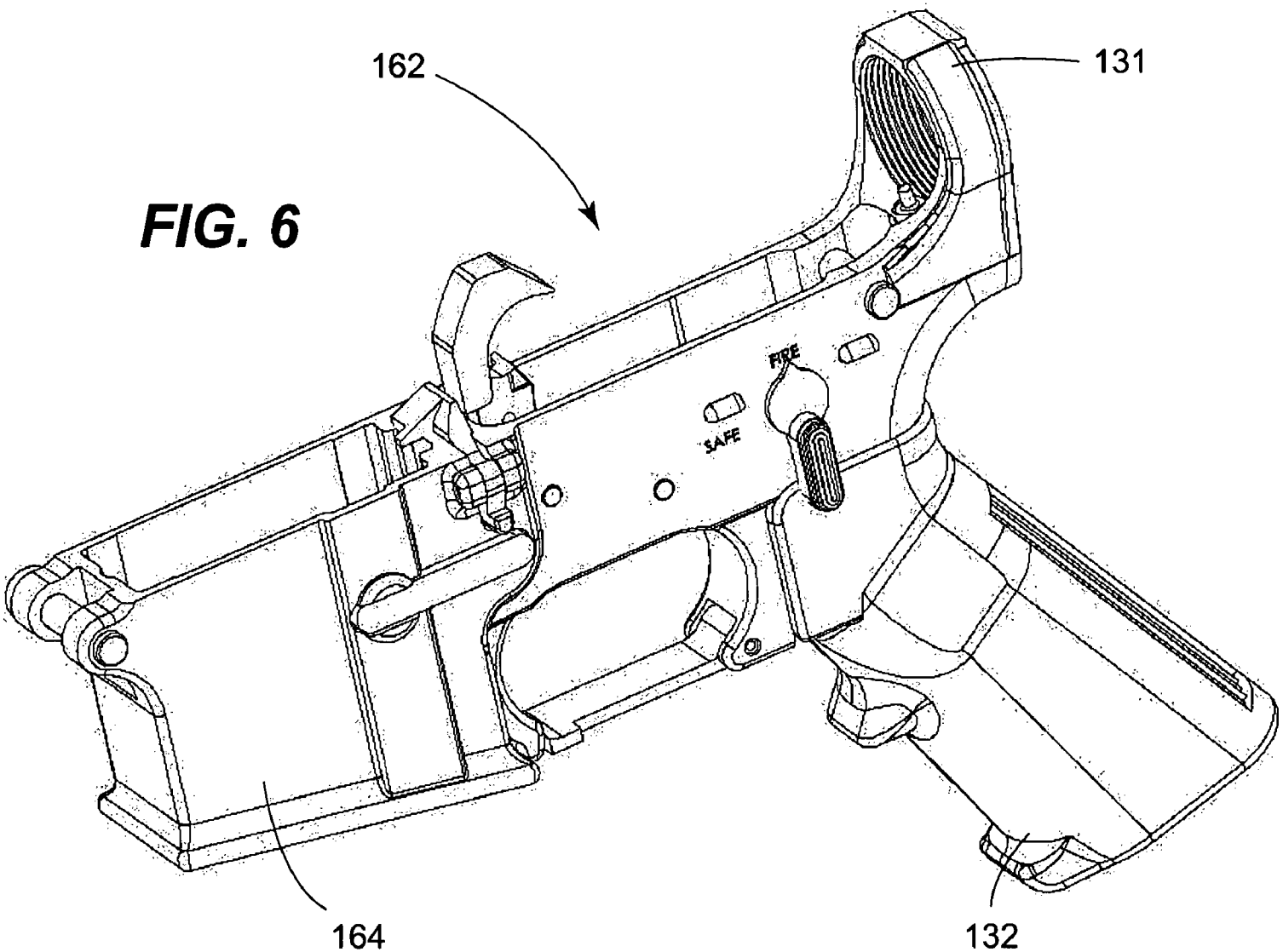
FIG. 6 is a perspective view of a conventional lower receiver comprised by a receiver system in accordance with the present invention.

The receiver system 150 is an embodiment of a configurable, dual-feed capable receiver system in accordance with the present invention. Specifically, the upper receiver body 152 is configured for having a plurality of different lower receiver bodies interchangeably mounted thereon, is configured for receiving magazine-fed ammunition through the first ammunition insertion port 154 and is configured for receiving belt-fed ammunition through a second ammunition insertion port 156. The lower receiver body 102 depicted in FIGS. 1-5 is an embodiment of a first lower receiver body that is interchangeably mountable on the upper receiver body 152. FIG. 6 depicts a second lower receiver body 162 having a magazine well 164 rather than a mounting structure configured for having an accessory directly mounted thereon. The magazine well 164 is positioned and configured for enabling magazine-fed ammunition to be supplied from within the magazine well 164 (e.g., from a magazine clip mounted in the magazine well 164) into the upper receiver body 152 through the first ammunition insertion port 154. Accordingly, the ability to interchange between the first lower receiver body and the second lower receiver body preserves use of the dual feed capability of upper receiver body 152.

Optionally, the upper receiver body 152 may be configured for receiving only belt-fed ammunition.

Figure 7:
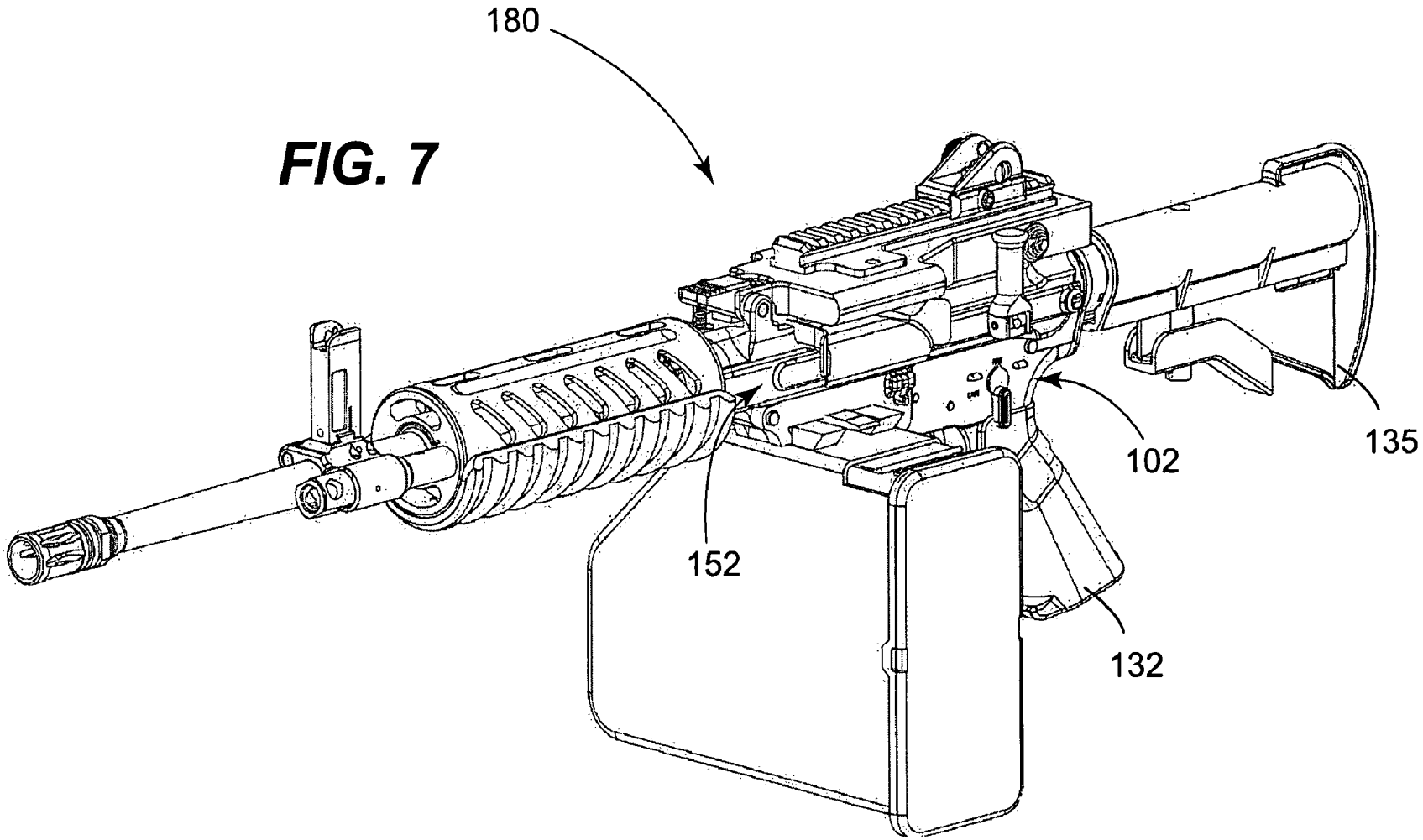
FIG. 7 is a perspective view of a firearm in accordance with the present invention.

FIG. 7 depicts an embodiment of a firearm in accordance with the present invention, which is referred to herein as the firearm 180. The firearm 180 includes the lower receiver body 102 depicted in FIGS. 1-6 and the upper receiver body 152 depicted in FIGS. 4-5. Accordingly, the firearm 180 comprises a receiver system in accordance with the present invention and exhibits the advantageous attributes and construction of a lower receiver body in accordance with the present invention.

It is disclosed herein that, in at least one embodiment of the present invention, a lower receiver body includes an integrally-formed, non-detachable hand grip and an integrally-formed, non-detachable butt-stock. For example, such an integrally-formed, non-detachable hand grip and integrally-formed, non-detachable butt-stock may be integrally-molded or integrally machined and non-detachable components of the lower receiver body 102. For example, the hand grip 132 depicted in FIGS. 1, 2, 6 and 7 and the butt-stock 135 depicted in FIG. 7 may be integrally-molded or integrally machined and non-detachable components of the lower receiver body 102.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice embodiments of the inventive disclosures made herein. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A receiver body, comprising:

an accessory mounting structure configured for being engaged with a mating mounting structure of an ammunition container and configured in a manner that inhibits ammunition cartridges from being fed through the receiver body into a mating cartridge chambering component of a firearm;

one of an integrally-formed, non-detachable hand grip mounting structure and an integrally-formed, non-detachable hand grip;

one of an integrally-formed, non-detachable butt-stock mounting structure and an integrally-formed, non-detachable butt-stock; and a trigger group mounting structure.

2. The receiver body of claim 1 wherein:

the trigger group mounting structure is configured for having a complete trigger group engaged therewith; and the accessory mounting structure is configured for having an accessory mounted directly thereon.

3. The receiver body of claim 1 including the butt-stock mounting structure, wherein the butt stock mounting structure extends above an upper receiver interface surface.

4. The receiver body of claim 3 wherein the accessory mounting structure, and the trigger group mounting structure are each an integrally-formed, non-detachable component of a lower receiver body.

5. The receiver body of claim 1 wherein the accessory mounting structure and the trigger group mounting structure are each an integrally-formed, non-detachable component of the receiver body.

6. The receiver body of claim 1 wherein the accessory mounting structure is configured for engaging a mating mounting structure of an accessory for enabling the accessory to be secured in a relatively fixed position with respect to the receiver body.

7. The receiver body of claim 6 wherein:

the accessory mounting structure includes a tapered engagement surface; and the mating mounting structure of the accessory includes a mating tapered engagement surface whereby engagement of said tapered engagement surfaces limits an engagement depth of the accessory with respect to the accessory mounting structure;

the accessory mounting structure is positioned forward of the trigger group mounting structure; and a lowest portion of the accessory mounting structure is vertically offset from an upper receiver interface surface of the receiver body by a distance less than an uppermost portion of a trigger window of the receiver body is vertically offset from the upper receiver interface surface.

8. The receiver body of claim 6 wherein:

the accessory mounting structure includes a keyed engagement structure;

the mating mounting structure of the accessory includes a mating keyed engagement structure configured for being engaged by the keyed engagement structure of the accessory mounting structure;

the accessory mounting structure is positioned forward of the trigger group mounting structure; and a lowest portion of the accessory mounting structure is vertically offset from an upper receiver interface surface of the receiver body by a distance less than an uppermost portion of a trigger window of the receiver body is vertically offset from the upper receiver interface surface.

9. The receiver body of claim 1 wherein:

the trigger group mounting structure is configured for having a complete trigger group engaged therewith;

the butt stock mounting structure extends above an upper receiver interface surface;

the accessory mounting structure, and the trigger group mounting structure are each an integrally-formed, non-detachable component of the receiver body;

the accessory mounting structure is configured for engaging a mating mounting structure of an accessory for enabling the accessory to be secured in a relatively fixed position with respect to the receiver body;

the accessory mounting structure includes a tapered engagement surface;

the mating mounting structure of the accessory includes a mating tapered engagement surface whereby engagement of said tapered engagement surfaces limits an engagement depth of the accessory with respect to the accessory mounting structure;

the accessory mounting structure is positioned forward of the trigger group mounting structure; and a lowest portion of the accessory mounting structure is vertically offset from an upper receiver interface surface of the receiver body by a distance less than an uppermost portion of a trigger window of the receiver body is vertically offset from the upper receiver interface surface.

10. A firearm, comprising:

an upper receiver body configured for receiving belt-fed ammunition through an upper surface thereof and for receiving magazine-fed ammunition through a lower surface thereof; and a lower receiver assembly attached to the upper receiver body with an upper receiver interface surface thereof positioned adjacent the lower surface of the upper receiver body, wherein the lower receiver assembly includes a receiver body having an accessory mounting structure, a trigger group mounting structure, one of an integrally-formed, non-detachable butt-stock mounting structure and an integrally-formed, non-detachable butt-stock, and one of a hand grip mounting structure and an integrally-formed, non-detachable hand grip; and wherein the accessory mounting structure is configured for being engaged with a mating mounting structure of an ammunition container and is configured in a manner that inhibits ammunition cartridges from being fed through the lower receiver body into the upper receiver body.

11. The firearm of claim 10, further comprising:

a detachable hand grip;

a detachable butt-stock; and a complete trigger group mounted on the trigger group mounting structure;

wherein the receiver body of the lower receiver assembly includes the butt-stock mounting structure and the hand grip mounting structure;

wherein the detachable hand grip is attached to the hand grip mounting structure; and wherein the detachable butt-stock is attached to the butt-stock mounting structure.

12. The firearm of claim 11 wherein:

the butt stock mounting structure extends above an upper receiver interface surface; and a centerline axis of the butt stock extends generally along a centerline axis of the upper receiver body.

13. The firearm of claim 10 wherein the accessory mounting structure, and the trigger group mounting structure are each an integrally-formed, non-detachable component of the receiver body of the lower receiver assembly.

14. The firearm of claim 10 wherein the accessory mounting structure is configured for engaging a mating mounting structure of an accessory for enabling the accessory to be secured in a relatively fixed position with respect to the receiver body of the lower receiver assembly.

15. The firearm of claim 14 wherein:

the accessory mounting structure includes a tapered engagement surface;

the mating mounting structure of the accessory includes a mating tapered engagement surface whereby engagement of said tapered engagement surfaces limits an engagement depth of the accessory with respect to the accessory mounting structure;

the accessory mounting structure is positioned forward of the trigger group mounting structure; and a lowest portion of the accessory mounting structure is vertically offset from an upper receiver interface surface of the receiver body by a distance less than an uppermost portion of a trigger window of the receiver body is vertically offset from the upper receiver interface surface.

16. The firearm of claim 14 wherein:

the accessory mounting structure includes a keyed engagement structure;

the mating mounting structure of the accessory includes a mating keyed engagement structure configured for being engaged by the keyed engagement structure of the accessory mounting structure;

the accessory mounting structure is positioned forward of the trigger group mounting structure; and a lowest portion of the accessory mounting structure is vertically offset from an upper receiver interface surface of the receiver body by a distance less than an uppermost portion of a trigger window of the receiver body is vertically offset from the upper receiver interface surface.

17. The firearm of claim 10, further comprising:

a detachable hand grip;

a detachable butt-stock; and a complete trigger group mounted on the trigger group mounting structure;

wherein the receiver body of the lower receiver assembly includes the butt-stock mounting structure and the hand grip mounting structure;

wherein the detachable hand grip is attached to the hand grip mounting structure; and wherein the detachable butt-stock is attached to the butt-stock mounting structure;

wherein the butt stock mounting structure extends above an upper receiver interface surface;

wherein a centerline axis of the butt stock extends generally along a centerline axis of the upper receiver body;

wherein the trigger group mounting structure is configured for having a complete trigger group engaged therewith;

wherein the accessory mounting structure, and the trigger group mounting structure are each an integrally-formed, non-detachable component of the receiver body of the lower receiver assembly;

wherein the accessory mounting structure is configured for engaging a mating mounting structure of an accessory for enabling the accessory to be secured in a relatively fixed position with respect to the receiver body of the lower receiver assembly;

wherein the accessory mounting structure includes a tapered engagement surface;

wherein the mating mounting structure of the accessory includes a mating tapered engagement surface whereby engagement of said tapered engagement surfaces limits an engagement depth of the accessory with respect to the accessory mounting structure;

the accessory mounting structure is positioned forward of the trigger group mounting structure; and a lowest portion of the accessory mounting structure is vertically offset from an upper receiver interface surface of the receiver body by a distance less than an uppermost portion of a trigger window of the receiver body is vertically offset from the upper receiver interface surface.

18. A receiver system, comprising:

an upper receiver body configured for receiving belt-fed ammunition through an upper surface thereof and for receiving magazine-fed ammunition through a lower surface thereof; and a lower receiver body including an accessory mounting structure, a trigger group mounting structure, one of a butt-stock mounting structure and an integrally-formed, non-detachable butt-stock and one of a hand grip mounting structure and an integrally-formed, non-detachable hand grip, wherein the accessory mounting structure is configured for being engaged with a mating mounting structure of an ammunition container and is configured in a manner that inhibits ammunition cartridges from being fed through the lower receiver body into the upper receiver body and wherein the upper receiver body and the lower receiver body are jointly configured for being interconnected with an upper receiver interface surface of the lower receiver body positioned adjacent the lower surface of the upper receiver body.

19. The receiver system of claim 18 wherein the accessory mounting structure and the trigger group mounting structure are each an integrally-formed, non-detachable component of the lower receiver body.

20. The receiver system of claim 18 wherein the accessory mounting structure is configured for engaging a mating mounting structure of an accessory for enabling the accessory to be secured in a relatively fixed position with respect to the lower receiver body.

21. The receiver body of claim 18, wherein:

the lower receiver body includes the butt-stock mounting structure; and the butt stock mounting structure extends above an upper receiver interface surface.

22. The receiver body of claim 21 wherein the accessory mounting structure and the trigger group mounting structure are each an integrally-formed, non-detachable component of a lower receiver body.

23. The receiver system of claim 18 wherein:

the accessory mounting structure includes a tapered engagement surface;

the tapered engagement surface is configured be being engaged with a mating tapered engagement surface of an accessory whereby engagement of said tapered engagement surfaces limits an engagement depth of the accessory with respect to the accessory mounting structure;

the accessory mounting structure is configured for engaging a mating mounting structure of the accessory thereby enabling the accessory to be secured in a relatively fixed position with respect to the lower receiver body;

the accessory mounting structure, and the trigger group mounting structure are each an integrally-formed, non-detachable component of the lower receiver body;

the accessory mounting structure is configured for engaging a mating mounting structure of the accessory for enabling the accessory to be secured in a relatively fixed position with respect to the lower receiver body;

the accessory mounting structure is positioned forward of the trigger group mounting structure; and a lowest portion of the accessory mounting structure is vertically offset from an upper receiver interface surface of the receiver body by a distance less than an uppermost portion of a trigger window of the receiver body is vertically offset from the upper receiver interface surface.

* * * * *